US005305473A

United States Patent [19]

Nakamura

[11] Patent Number: 5,305,473

[45] Date of Patent: Apr. 26, 1994

[54] URINAL HAVING A SMELL RELEASE FUNCTION

[75] Inventor: Shouichi Nakamura, Aichi, Japan

[73] Assignee: Inax Corporation, Tokoname, Japan

[21] Appl. No.: 853,423

[22] Filed: Mar. 18, 1992

[30] Foreign Application Priority Data

Mar. 29, 1991 [JP] Japan ..... 3-19948[U]

[51] Int. Cl.[5] ..... E03D 13/00

[52] U.S. Cl. ..... 4/306

[58] Field of Search ..... 4/301, 306, 347, 350, 4/351, 213, 216, 219

[56] References Cited

U.S. PATENT DOCUMENTS

| | | | |
|---|---|---|---|
| 704,471 | 7/1902 | Brown | 4/306 X |
| 921,096 | 5/1909 | Ebinger | 4/306 |
| 945,837 | 1/1910 | Baker et al. | 4/306 |
| 947,082 | 1/1910 | Palmer | 4/306 |
| 1,441,007 | 1/1923 | Littlefield | 4/306 X |
| 1,972,774 | 9/1934 | Closet . | |
| 2,646,574 | 7/1958 | Gillespie . | |
| 3,805,304 | 4/1974 | Ikehata | 4/213 X |
| 4,035,851 | 7/1977 | Wyeth et al. | 4/301 |
| 4,133,060 | 1/1979 | Webb | 4/351 X |
| 4,993,083 | 2/1991 | Lemieux | 4/213 |

FOREIGN PATENT DOCUMENTS

| | | | |
|---|---|---|---|
| 384317 | 11/1931 | Belgium . | |
| 0206312 | 12/1986 | European Pat. Off. | 4/347 |
| 3-12978 | 2/1991 | Japan . | |
| 0172422 | 7/1991 | Japan | 4/301 |
| 8002577 | 12/1980 | PCT Int'l Appl. | 4/347 |
| 8806661 | 9/1988 | PCT Int'l Appl. | 4/347 |
| 353312 | 12/1957 | Switzerland . | |

*Primary Examiner*—William A. Cuchlinski
*Assistant Examiner*—John L. Beres
*Attorney, Agent, or Firm*—Kanesaka & Takeuchi

[57] ABSTRACT

A urinal having a smell release function, comprising: a bowl unit including a drain trap provided at the bottom thereof; a urinal shell unit for surrounding the bowl unit with an air space being interposed between the bowl unit and the shell unit itself; and smell inlets through which the air space communicates with at least one of an interior of the bowl unit and a lower external surface of the urinal. In this urinal the air space communicates with a secondary side of the drain trap, and a fan for blowing the air within the air space towards the secondary side of the drain trap is provided in the vicinity of the drain trap.

3 Claims, 10 Drawing Sheets

URINAL HAVING A SMELL RELEASE FUNCTION

BACKGROUND OF THE INVENTION

1. Field of the Invention

The present invention relates to a urinal incorporating a smell release function capable of releasing an offensive smell from an interior or peripheral portions of the urinal.

2. Description of the Related Art

Urinals constructed to release the smell from the interior or peripheral portion of the urinal have hitherto been disclosed in Japanese Patent Application No. 68245/1989 (Japanese Utility Model Laid-Open No. 12978/1991) and Japanese Patent Application No. 68246/1989 (Japanese Utility Model Laid-Open No. 12979/1991).

Each of those urinals having the smell release function includes a urine gathering wall for receiving the urine and a urinal shell unit which surrounds the urine gathering wall. An air space is formed between the urine gathering wall and the shell unit.

In those urinals, an introduction port for the offensive smell is formed in a bowl or the lower part of the urinal. A smell release port is provided in a rear surface of the urinal, thereby releasing the smell sucked in the above-mentioned air space into a duct connected to the smell release port.

In those urinals each having the smell release function, the smells in the bowl and emitted from urine splashed over and adhered to the lower part of the urinal are immediately released through the air space. Exhibited is a remarkably good effect of releasing the smell in the whole toilet room.

In the urinals disclosed in Japanese Patent Application Nos. 68245/1989 and 68246/1989, a dedicated smell release duct is required to be laid.

OBJECT AND SUMMARY OF THE INVENTION

It is a primary object of the present invention to provide a urinal capable of surely releasing the smell without a dedicated smell release duct.

To this end, according to one aspect of the invention, there is provided a urinal having a smell release function, comprising: a bowl unit including a drain trap provided at the bottom thereof; a urinal shell unit for surrounding the bowl unit with an air space being interposed between the bowl unit and the shell unit itself; and smell inlets through which the air space communicates with at least one of an interior of the bowl unit and a lower external surface of the urinal, characterized in that the air space communicates with a secondary side of the drain trap, and that a fan for blowing the air within the air space towards the secondary side of the drain trap is provided in the vicinity of the drain trap.

The urinal according to the present invention eliminates the necessity for a dedicated smell release duct, because the smell introduced into the air space is fed into the drain pipe.

BRIEF DESCRIPTION OF THE DRAWINGS

Other objects and advantages of the invention will become apparent during the following discussion taken in conjunction with the reference drawings, in which.

DESCRIPTION OF THE PREFERRED EMBODIMENTS

Figure 1:
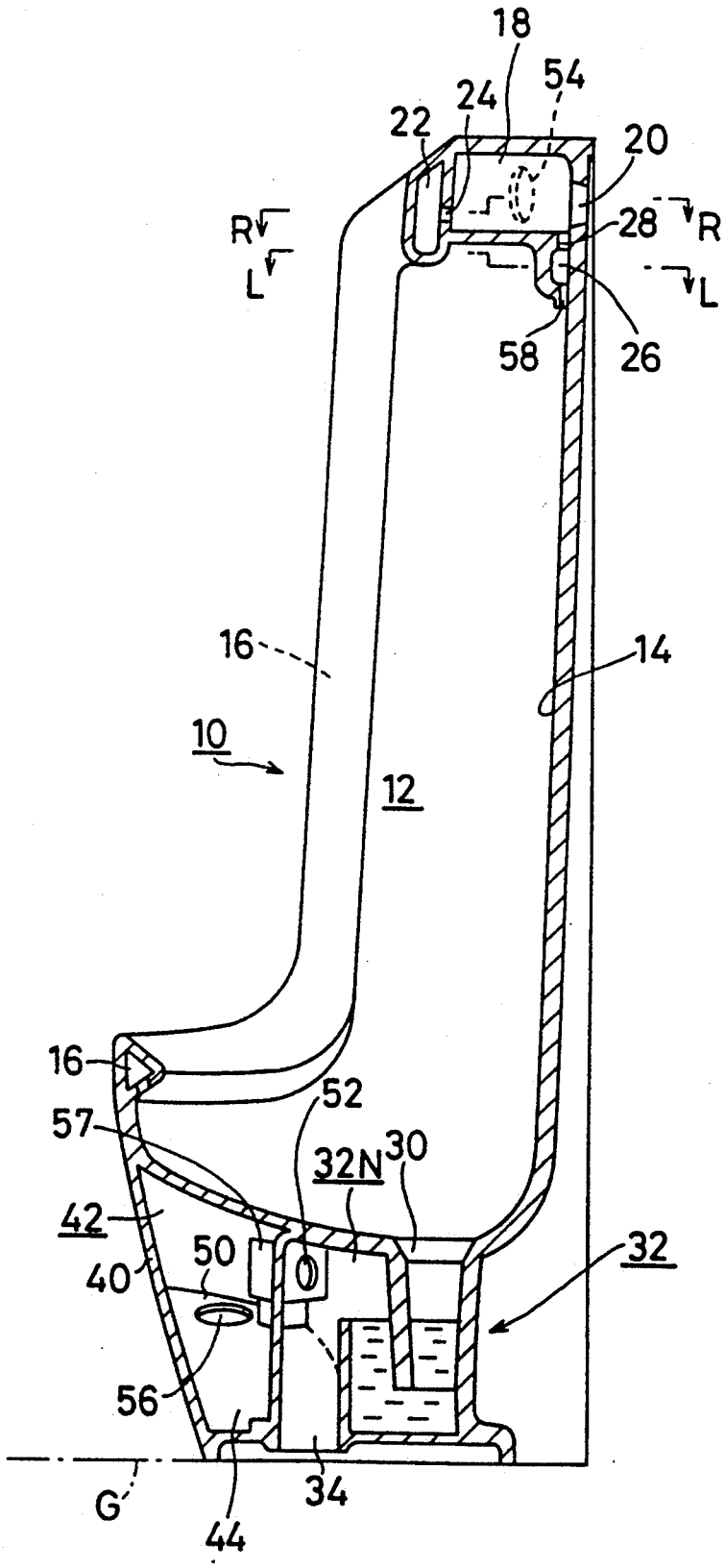
FIG. 1 is a vertical sectional view illustrating a urinal in an embodiment of the present invention.
Figure 2:
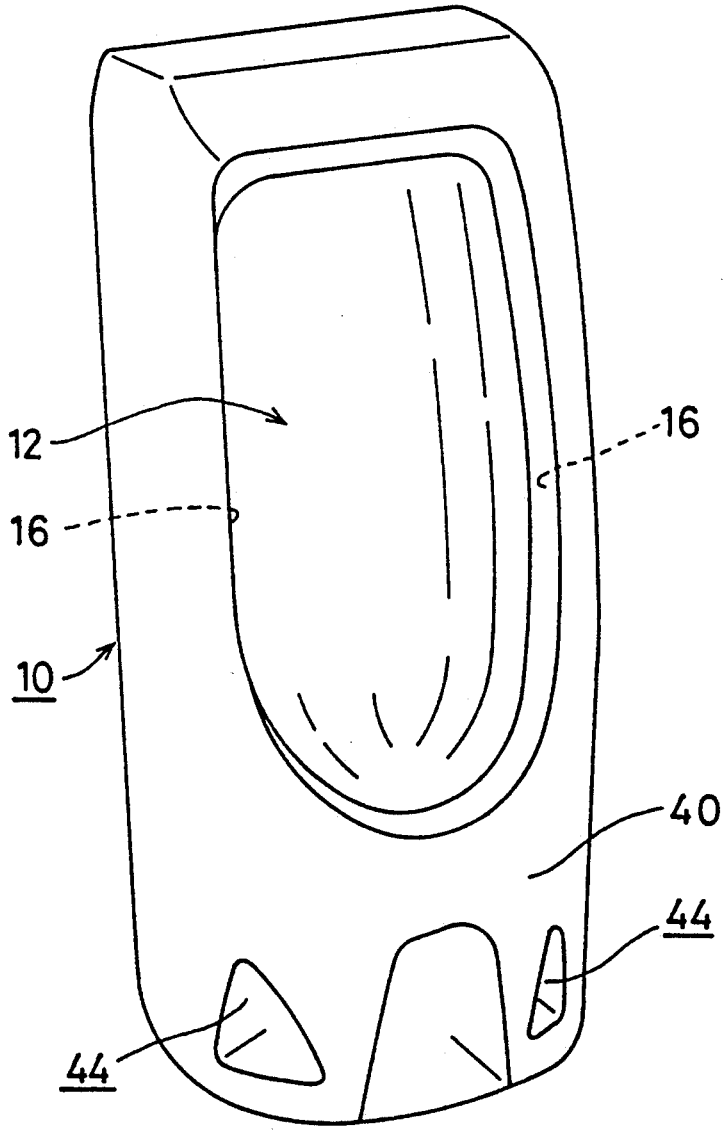
FIG. 2 is a perspective view depicting the same urinal.

A urinal incorporating a smell release function in an embodiment of the present invention will hereinafter be described with reference to the drawings.

A urinal 10 in this embodiment is classified as a stool type and includes a urine gathering unit (bowl unit) 12 surrounded with a urine gathering wall 14. The urine gathering wall 14 assumes such a horizontal sectional configuration that it curves substantially in a circular arc. A rim water passageway 16 extending in the up-and-down directions is formed in a front fringe of the urine gathering wall 14 which is curved forwards in the lower portion.

A water supply chamber 18 is provided in an upper central part of the urine gathering unit 12. A rear surface of the urinal is formed with a water supply port 20 for supplying the water to the water supply chamber 18. A front water distribution passageway 22 is formed in the front part of the water supply chamber 18 of the urinal. This front water distribution passageway 22 extends in the right-and-left directions of the urinal, and the right-and-left ends thereof communicate with the rim water passageway 16. The front water distribution passageway 22 communicates via a water flow port 24 with the water supply chamber 18.

A rear water distribution passageway 26 is provided along the lower part of the water supply chamber 18. This rear water distribution passageway 26 also horizontally extends in the right-and-left directions of the urinal 10. The rear water distribution passageway 26 communicates via a water flow port 28 with the water supply chamber 18.

A drain port 30 is formed in the bottom of the urine gathering unit 12. The drain port 30 communicates with a discharge port 34 formed in the bottom of the urinal 10 through a drain trap 32.

Figure 3:
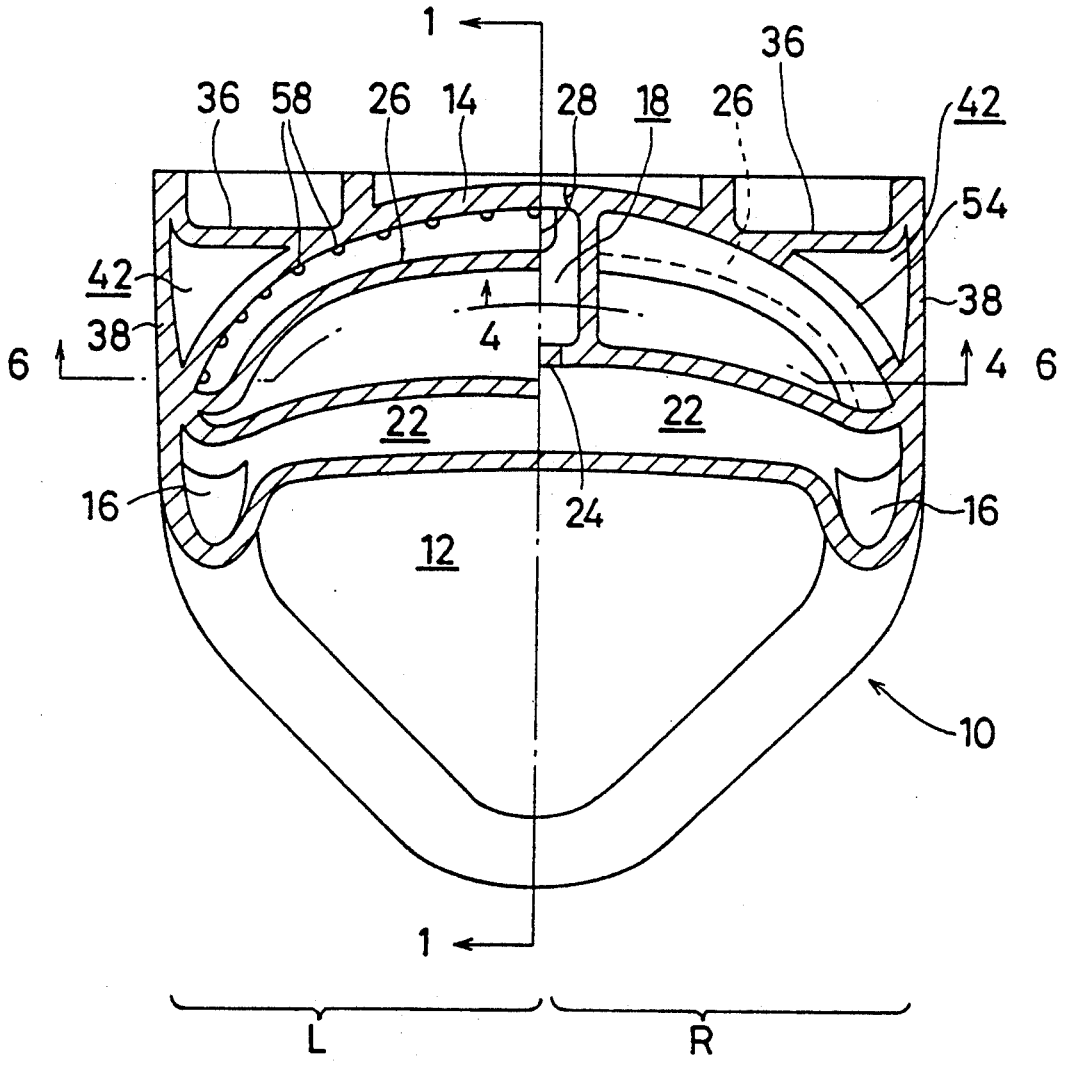
FIG. 3 is a cross-sectional view illustrating the principal portion of the urinal.
Figure 4:
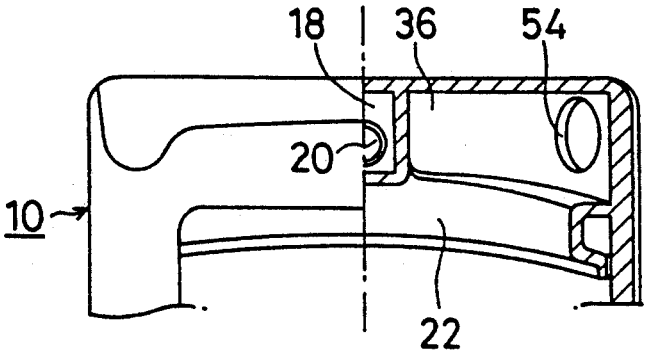
FIG. 4 is a front elevation illustrating the principal portion of the urinal.

As illustrated mainly in FIG. 3, a rear wall 36 is provided in rear of the urine gathering wall 14 and along the right-and-left edges of the urinal 10. Further, a side wall 38 is provided to cover the right-and-left portions of the urine gathering wall 14. The rear end of the side wall 38 leads to the rear wall 36. Besides, the front edge of the side wall 38 leads to the urine gathering wall 14. The lower front part of the urinal 10 is surrounded with a skirt member 40.

The rear wall 36, the side wall 38 and the skirt member 40 are combined to constitute a urinal shell unit. An air space 42 is then formed between the urinal shell unit and the urine gathering wall 14.

Figure 6:
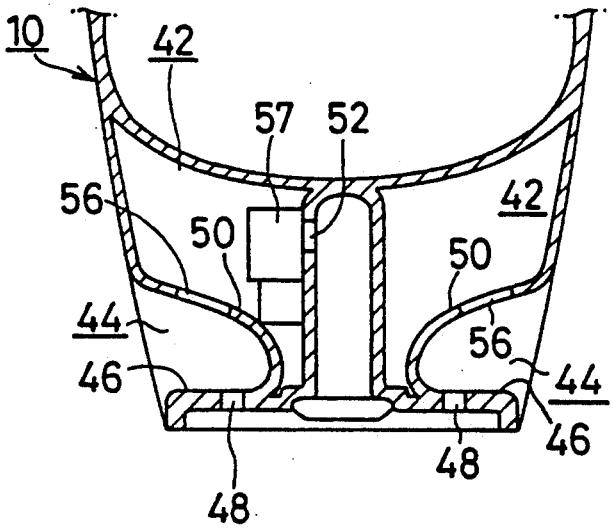
FIG. 6 is a vertical sectional view illustrating the principal portion of the urinal.
Figure 5:
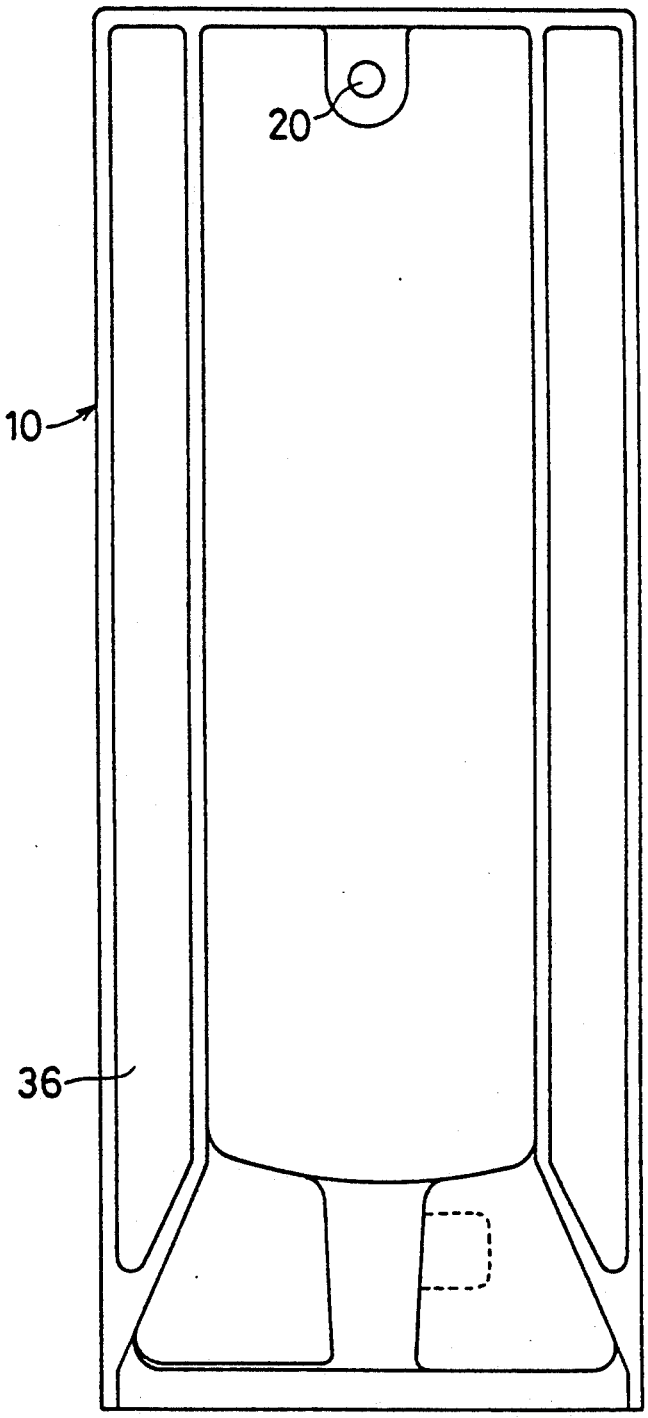
FIG. 5 is a rear view illustrating the urinal.

Cavities 44 are formed in the front and side portions of the skirt member 40 by depressing the skirt member 40. As illustrated in FIG. 6, a bolt insertion hole 48 is bored in a bottom surface 46 of this cavity. The urinal 10 is fixed to a floor surface of a toilet room by inserting a bolt (not illustrated) into this bolt insertion hole 48.

A first smell release port 54 is formed in an upper portion of the urine gathering wall 14 to permit a communication between the air space 42 and the urine gathering unit 12. A second smell release port 56 is provided in a ceiling wall 50 of the cavity 44.

Further, an air exhaust port 52 is bored so that a secondary side 32N of the drain trap 32 communicates with the air space 42. An exhaust fan 57 is so provided in the air space 42 as to confront this air exhaust port 52.

In the thus constructed urinal 10, the washing water is supplied via the water supply port 20 to the water supply chamber 18 and further supplied to the front water distribution passageway 22 and the rear water distribution passageway 26 as well. The water supplied to the front water distribution passageway 22 flows in the rim water passageway 16 and is discharged from an outflow port formed in the course of this passageway towards the urine gathering unit 12. Besides, the water supplied to the rear water distribution passageway 26 flows out of outflow holes 58 formed at predetermined intervals along the urine gathering wall 14 under the rear water distribution passageway 26. The water then flows down along the urine gathering wall 14. The urine and the washing water are discharged through the drain port 30, the drain trap 32 and the discharge port 34.

In this urinal 10, the air exhaust port 52 communicates with the secondary side 32N of the drain trap 32. Hence, when the exhaust fan 57 is operated, an offensive smell generated in the urine gathering unit 12 is drawn via the first smell release port 54 into the air space 42. Then, the smell flows down in the air space 42 and is released into a drain pipe (unillustrated) through the secondary side 32N of the drain trap 32 and the discharge port 34.

The offensive smell emitted from the urine scattered within the cavity 44 is drawn into the air space 42 from the second smell release port 56 of the ceiling wall of the cavity 44 and is similarly discharged into a drain pipe (unillustrated) via the air exhaust port 52.

Figure 7:
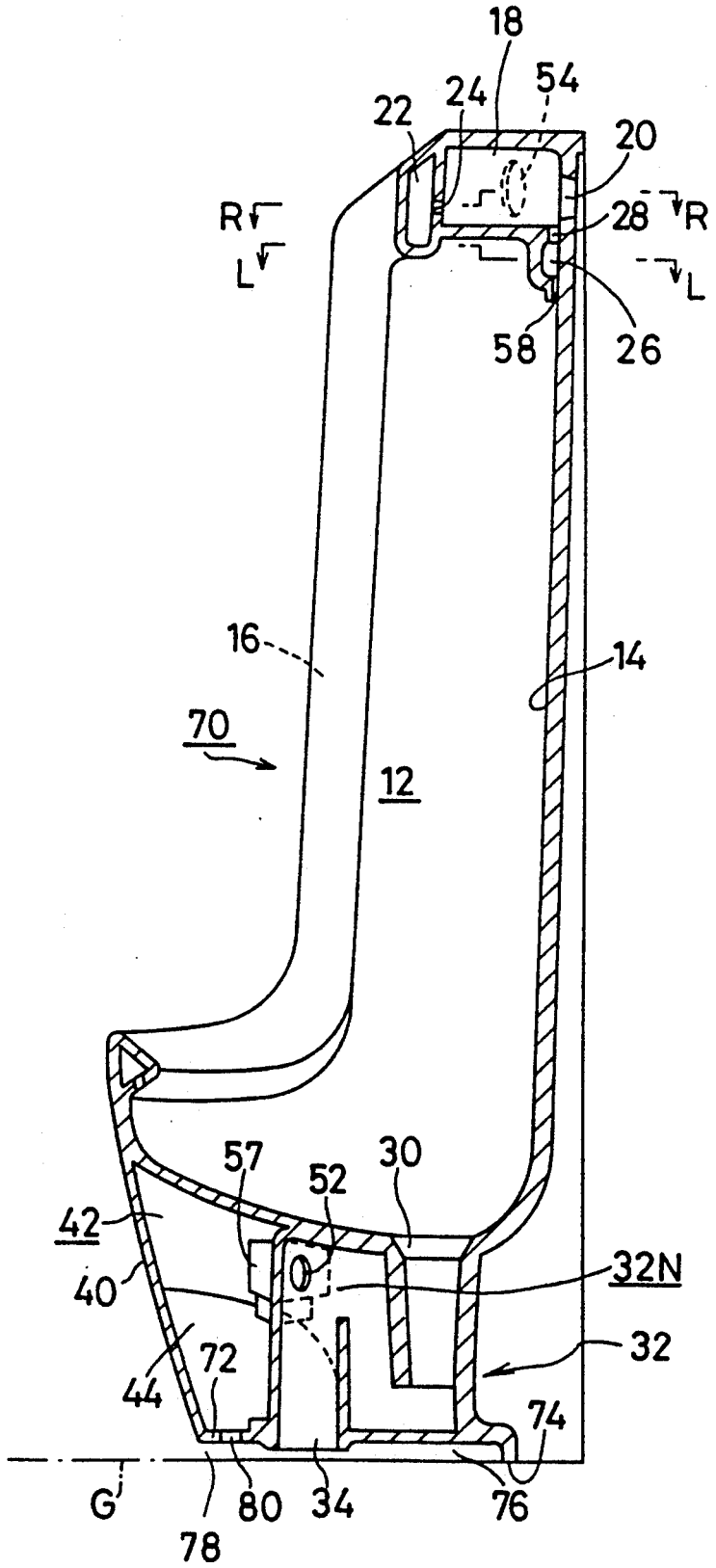
FIG. 7 is a vertical sectional view showing another embodiment.
Figure 8:
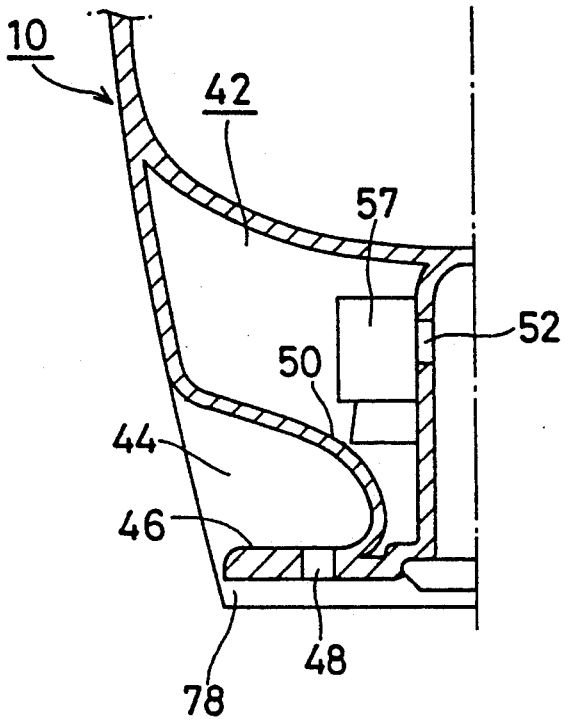
FIG. 8 is a vertical sectional view illustrating the principal portion of the same urinal.
Figure 9:
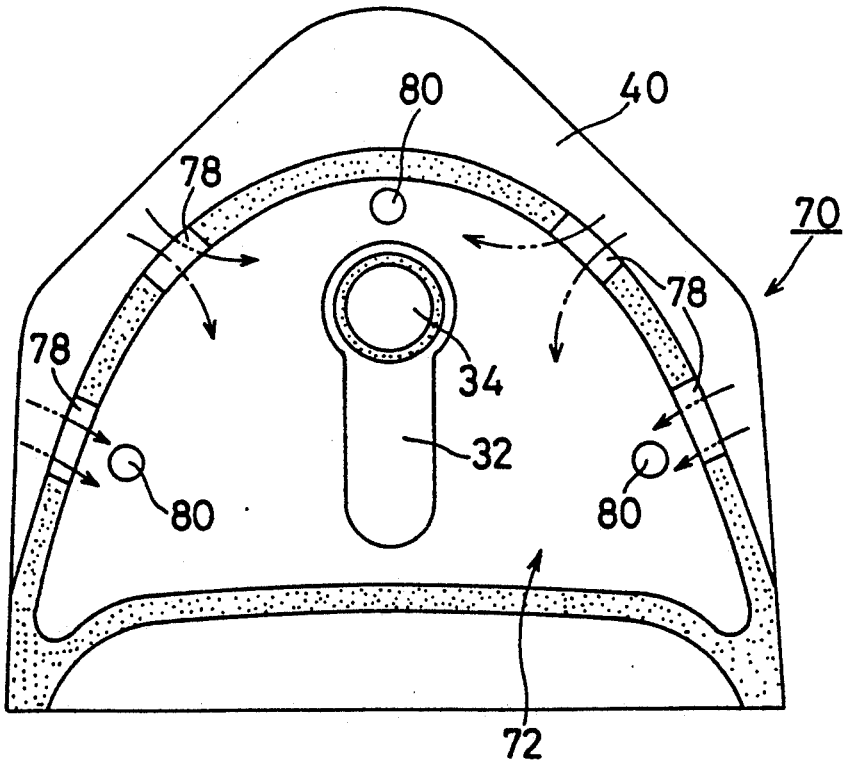
FIG. 9 is a bottom view depicting the same urinal.

Note that the cavity 44 opens to an installing floor surface G for the urinal 10. Besides, this cavity 44 is so formed that an opening area thereof increases gradually from the rear side towards an inlet side. With this arrangement, when the exhaust fan 57 is operated, the air containing the offensive smell drifting in the vicinity of the floor surface G flows along the floor surface G towards the cavity 44. Next, the air flows into the cavity 44 while being gathered therein and further runs into the air space 42 from the second smell release port 56. Generally, the smell drifting in the vicinity of the floor surface G tends to flow along the floor surface G. Therefore, when the exhaust fan 57 is operated, the smell emitted from the urine splashed over the floor surface is immediately sucked via the second smell release port 56 and then released into the drain pipe through the secondary side 32N of the drain trap 32. FIG. 7 is a vertical sectional view illustrating a urinal 70 in another embodiment of the present invention. FIG. 8 is a vertical sectional view depicting a cavity similar to that in FIG. 6. FIG. 9 is a bottom view of the urinal 70.

Referring to FIGS. 7 through 9, a bottom wall 72 constituting a bottom surface of the urinal 70 is so positioned more upwards by a predetermined distance than a bottom end 74 as to float from the installing floor surface G. A cavity 76 is then formed between this bottom wall 72 and the floor surface G. Notches 78 are formed at a lower edge of the skirt member 40, whereby the toilet room space outside the urinal 70 communicates with an interior of this cavity 76. Further, the bottom wall 72 is formed with a second smell release port 80 through which the interior of the cavity 76 communicates with the interior of the air space 42. Except for the fact that the second smell release port 56 is not provided and the second small release port 80, the other constructions are the same as those in the embodiment shown in FIGS. 1 to 6.

Also in the urinal 70 illustrated in FIGS. 7 to 9, when the exhaust fan 57 is operated, the smell within the urine gathering unit 12 is released into the drain pipe from the secondary side 32N of the drain trap 32. Besides, the smell drifting in the neighborhood of the floor surface G is, as indicated by two-dotted lines of FIG. 9, sucked into the cavity 76 via the notches 78. Subsequently, the smell flows into the air space 42 via smell release holes 80 bored in the bottom wall 78 and is released into the drain pipe from the air exhaust port 52.

Figure 10:
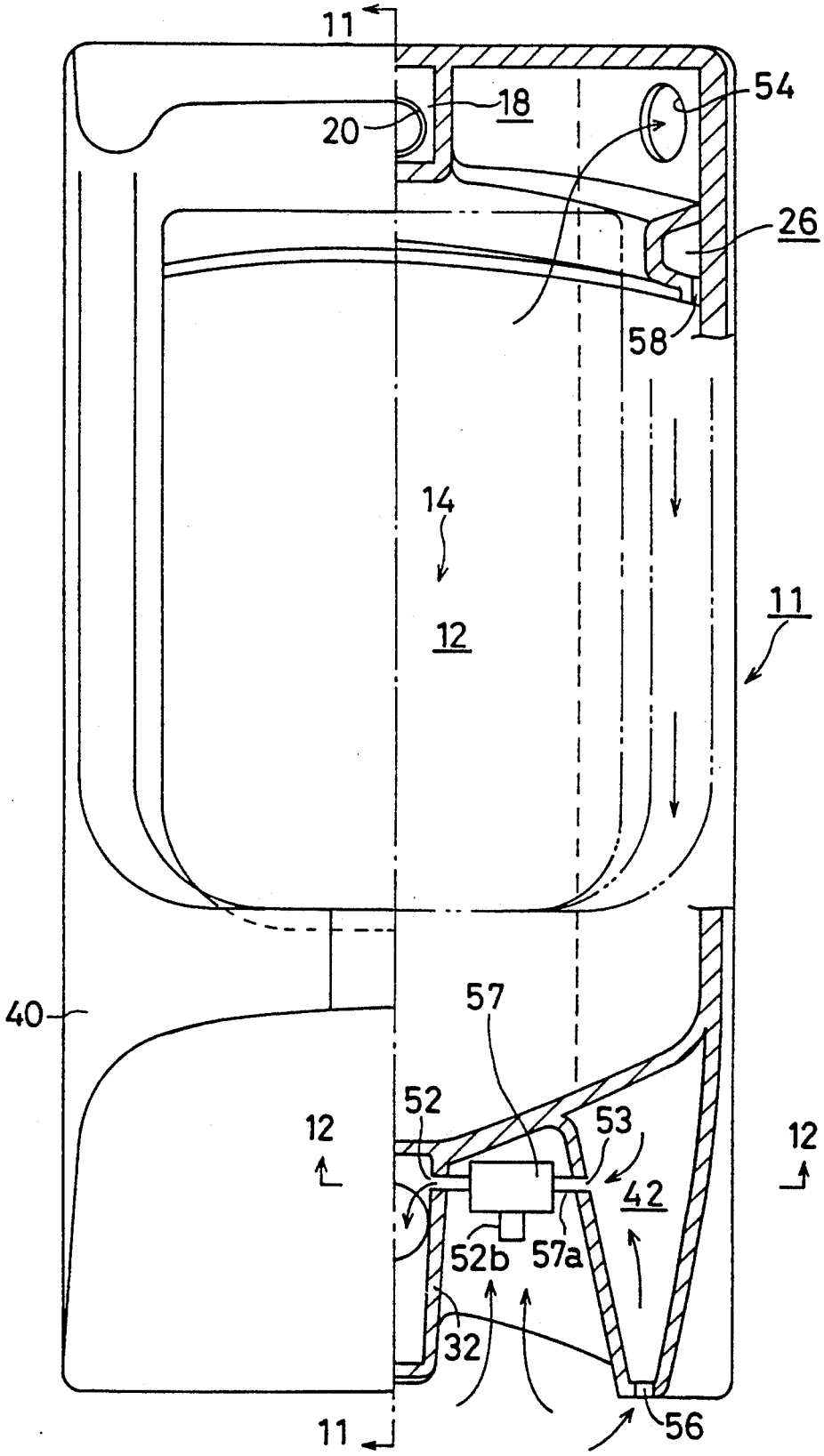
FIG. 10 is a front elevation showing still another embodiment.
Figure 11:
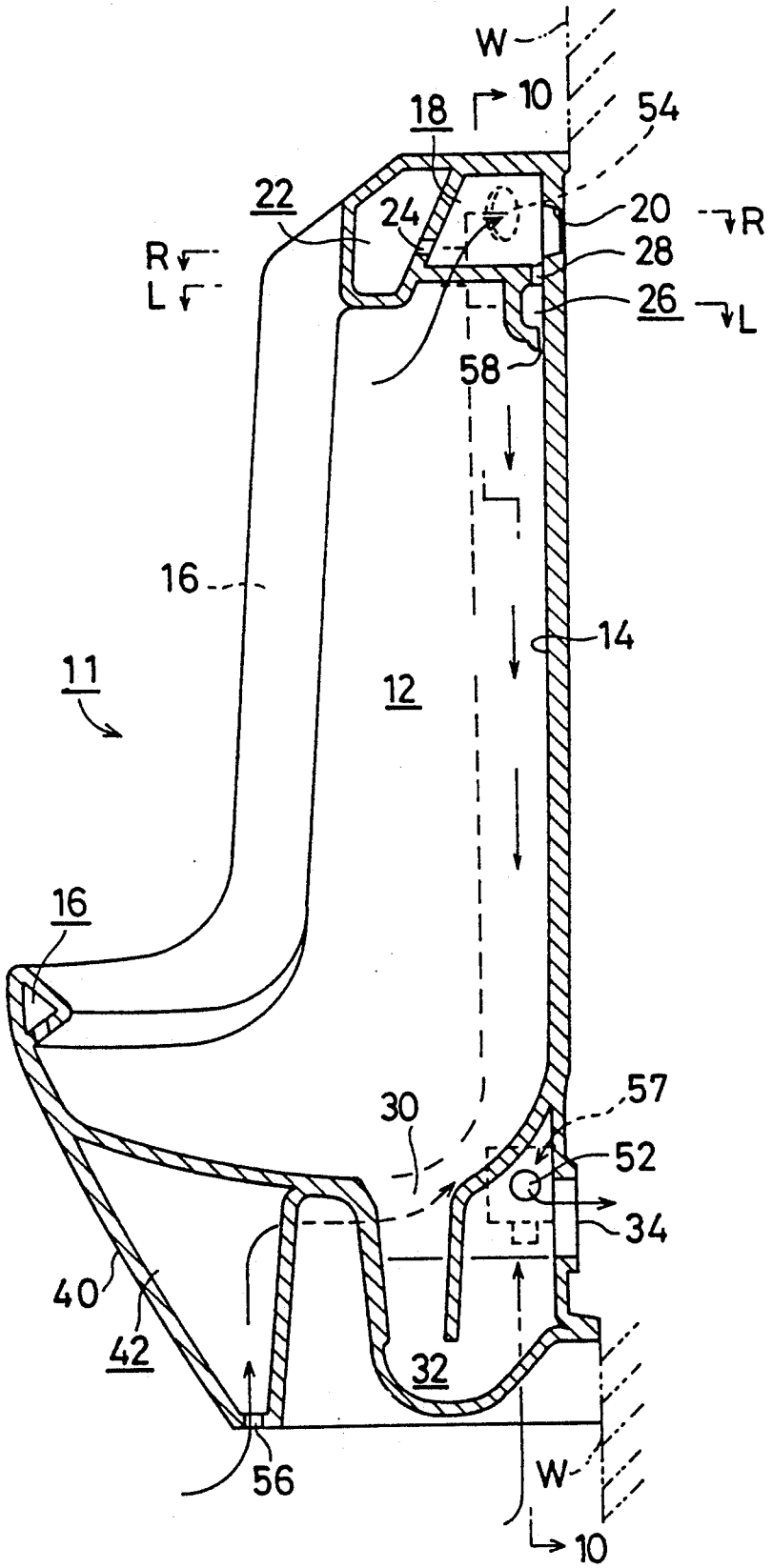
FIG. 11 is a vertical sectional view depicting the urinal of FIG. 10.
Figure 12:
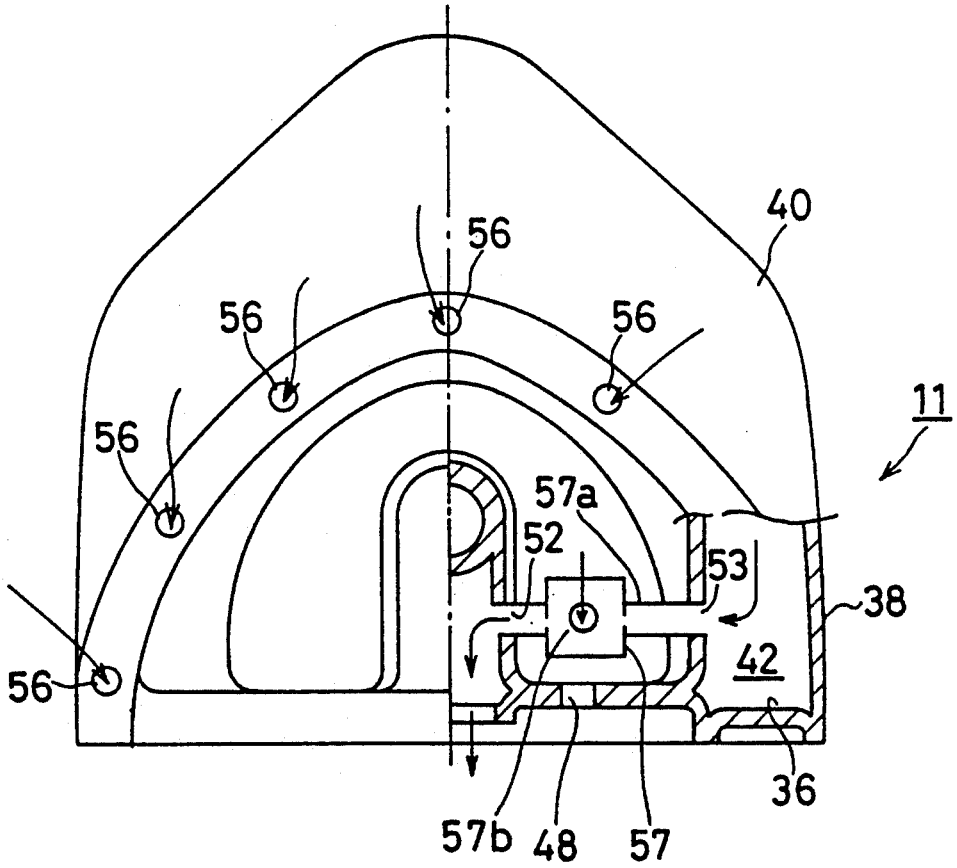
FIG. 12 is a bottom view illustrating the urinal of FIG. 10.

FIG. 10 is a front elevation depicting a urinal in still another embodiment of the present invention. A right half of FIG. 10 represents a section taken along the line 10—10 of FIG. 11. FIG. 11 is a vertical sectional view (taken along the line 11—11 of FIG. 10). FIG. 12 is a bottom view of the urinal, wherein the principal portion of the right half thereof represents a section taken along the line 12—12 of FIG. 10.

A urinal 11 in accordance with this embodiment is classified as a wall hanging type but takes the same construction as that of the above-described stool type urinals 10, 70 except the lower configuration. More specifically, the urine gathering unit 12 thereof is surrounded with the urine gathering wall 14. The urine gathering wall 14 assumes such a horizontal sectional configuration that it curves substantially in a circular arc. A rim water passageway 16 extending in the up-and-down directions is formed in a front fringe of the urine gathering wall 14 which is curved forwards in the lower portion. forwards.

A water supply chamber 18 is provided in an upper central part of the urine gathering unit 12. A rear surface of the urinal is formed with a water supply port 20 for supplying the water to the water supply chamber 18. A front water distribution passageway 22 is formed in the front part of the water supply chamber 18 of the urinal. This front water distribution passageway 22 extends in the right-and-left directions of the urinal, and the right-and-left ends thereof communicate with the rim water passageway 16. The front water distribution passageway 22 communicates via a water flow port 24 with the water supply chamber 18.

A rear water distribution passageway 26 is provided along the lower part of the water supply chamber 18. This rear water distribution passageway 26 also horizontally extends in the right-and-left directions of the urinal 11. The rear water distribution passageway 26 communicates via a water flow port 28 with the water supply chamber 18.

A drain port 30 is formed in the bottom of the urine gathering unit 12. The drain port 30 communicates with a discharge port 34 formed in the bottom of the urinal 11 through a drain trap 32.

A rear wall 36 is provided in rear of the urine gathering wall 14 and along the right-and-left edges of the urinal 11. Further, a side wall 38 is provided to cover the right-and-left portions of the urine gathering wall 14. The rear end of the side wall 38 leads to the rear wall 36. Besides, the front edge of the side wall 38 leads to the urine gathering wall 14. The lower front part of the urinal 11 is surrounded with a skirt member 40.

The rear wall 36, the side wall 38 and the skirt member 40 are combined to constitute a urinal shell unit. An air space 42 is then formed between the urinal shell unit and the urine gathering wall 14.

A bolt insertion hole 48 is bored in the lower part of the rear wall 36. The urinal 11 is fixed to the wall surface (urinal fitting wall surface) W of the toilet room by inserting a bolt (unillustrated) into the bolt insertion hole 48. A first smell release port 54 is formed in the upper part of the urine gathering wall 14 so that the air space 42 communicates with the urine gathering unit 12. A second smell release port 56 is formed in the bottom surface of the urinal 11. Air exhaust ports 53 and 52 are bored in the rear part of the skirt member 40 as well as in the trap wall surface, respectively so that the air space 42 communicates with the secondary side 32N of the drain trap 32. An exhaust fan 57 is provided between these air exhaust ports 52, 53. This exhaust fan 57 includes two suction ports **57*a*, 57*b*. The suction port 57*a* is connected to the air exhaust port 53, while the suction port 57*b* opens to a space around the lower part of the urinal 11**.

Note that a hook member is, though not illustrated, fitted to the rear surface of the urinal 11. This hook member is caught by a hook metal fitting (unillustrated) provided on the urinal fitting wall surface W.

A water supply pipe and a drain pipe are laid inwardly of the urinal fitting wall surface W. The water supply pipe is connected to the water supply port 20. The drain pipe is connected to the discharge port 34.

In the thus constructed urinal 11, the washing water is supplied via the water supply port 20 to the water supply chamber 18 and further supplied to the front water distribution passageway 22 and the rear water distribution passageway 26 as well. The water supplied to the front water distribution passageway 22 flows in the rim water passageway 16 and is discharged from an outflow port formed in this passageway towards the urine gathering unit 12. Besides, the water supplied to the rear water distribution passageway 26 flows out of outflow holes 58 formed at predetermined intervals along the urine gathering wall 14 under the rear water distribution passageway 26. The water then flows down along the urine gathering wall 14. The urine and the washing water are discharged through the drain port 30, the drain trap 32 and the discharge port 34.

When the exhaust fan 57 is operated an offensive smell generated in the urine gathering unit 12 rises in the urine gathering unit 12 and runs via the first smell release port 54 into the air space 42. Then, the smell flows down in the air space 42 and is released into the drain pipe through the secondary side 32N of the drain trap 32 from the air exhaust ports 53, 52. Further, the offensive smell emitted from the urine splashed over the lower area of the urinal 11 flows into the air space 42 via the second smell release port 56 formed in the bottom surface of the urinal 11. The smell is released into the drain pipe from the air exhaust ports 53, 52 and the secondary side 32N of the drain trap. Besides, the smell in the lower part of the urinal is immediately sucked also via the suction port **57*b* of the exhaust fan 57 and similarly released into the drain pipe from the secondary side 32N** of the drain trap.

Note that a check valve for preventing a back flow into the air space 42 from the drain pipe may be provided according to the present invention.

In the embodiment discussed above, the rear wall 36 is formed for defining the air space 42. Where the urinal is closely fitted to the wall surface W, however, this rear wall 36 may be omitted.

As is obvious from the embodiments given above, the urinals according to the present invention are capable of surely releasing, into the drain pipe, the offensive smells drifting along the floor surface of the toilet room as well as in the urine gathering unit and emitted from the urine adhered to the lower part of the urinal.

According to the present invention, a special exhaust duct is not required, and the urinal is simply installed.

invention have been described in detail with reference to the accompanying drawings, it is to be understood that the present invention is not limited to those embodiments. Various changes or modification may be effected therein by one skilled in the art without departing from the scope or spirit of the invention.

What is claimed is:

1. A urinal to be hung on a room wall, comprising:

a urine gathering unit including a drain port formed in a bottom surfaces thereof, a urine gathering wall. extending upward from said bottom surface, with its front part opened for use;

side walls extending vertically along opposite sides of said urine gathering wall;

a first air space defined by said urine gathering wall, said side walls and a rear wall so as to extend vertically along said urine gathering wall;

a drain trap disposed on a lower side of said bottom surface of said urine gathering unit so as to communicate with said drain port and having a secondary side to be connected to a drain line;

first communicating means provided at an upper portion of said urine gathering wall for causing said first air space to communicate with an upper part of said urine gathering unit;

second communicating means provided at a wall of said secondary side of said drain trap for causing said first air space to communicate with said secondary side of said drain trap, said second communicating means having a first port and a second port, said second port being provided through a wall of said drain trap;

a skirt member provided along peripheral edges of a bottom surface of said urine gathering unit, said skirt member being spaced away from said drain trap, said first port being provided through the skirt member, a second air space defined by said skirt member and the bottom surface of said urine gathering unit, and an exhaust fan for blowing air within said second air space to said secondary side of said drain trap, said exhaust fan being provided between a rear side of said skirt member and said drain trap and including a first suction port connected to said second port and a second suction port opened to a space around a lower part of said urinal so that air around the lower part of said urinal is forcibly drawn into a drain pipe through said secondary side of said drain trap.

2. The urinal as set forth in claim 1, wherein said first port is provided through said skirt member for directly introducing the air drifting over a lower part of said urinal into said second air space.

3. The urinal as set forth in claim 1, wherein said second suction port directly sucks the air in a lower part of said urinal and blows it to the secondary side of said drain trap.

* * * * *